United States Patent [19]

Braid

[11] 4,217,232

[45] Aug. 12, 1980

[54] ANTIOXIDANT COMPOSITIONS

[75] Inventor: Milton Braid, Westmont, N.J.

[73] Assignee: Mobil Oil Corporation, New York, N.Y.

[21] Appl. No.: 971,979

[22] Filed: Dec. 21, 1978

[51] Int. Cl.[2] ..... C10M 1/54

[52] U.S. Cl. ..... 252/46.4; 252/45; 252/75; 252/400 R; 260/139; 260/665 G

[58] Field of Search ..... 252/45, 46.4, 75, 400 R; 260/125, 139, 665 G

[56] References Cited

U.S. PATENT DOCUMENTS

| | | | |
|---|---|---|---|
| 2,855,397 | 10/1958 | Ramsden | 260/665 G X |
| 3,642,631 | 2/1972 | Gisser et al. | 252/45 X |
| 3,644,282 | 2/1972 | Bresson | 252/404 X |
| 3,652,495 | 3/1972 | Dean | 252/404 X |
| 3,697,499 | 10/1972 | Myers | 260/139 |
| 3,781,361 | 12/1973 | Wheeler | 260/570 R |
| 3,873,454 | 3/1975 | Horodysky et al. | 252/45 X |
| 3,925,414 | 12/1975 | Landis et al. | 252/45 X |
| 4,090,970 | 5/1978 | Braid | 252/42.7 |

OTHER PUBLICATIONS

Kharasch et al., "Grignard Reactions of Nonmetallic Substances", Chapt. XXI, p. 1301, Chapt. XV, p. 1036, 1954.

Nesmeyanov et al., "Methods of Elements–Organic Chemistry" vol. 2, Mg, Be, Ca, Sr, Ba, p. 631, 1967.

*Primary Examiner*—Andrew Metz

*Attorney, Agent, or Firm*—Charles A. Huggett; Raymond W. Barclay; Howard M. Flournoy

[57] ABSTRACT

Compositions having highly effective antioxidant characteristics are provided comprising organic media, normally susceptible to oxidation, such as oils of lubricating viscosity, containing a minor amount sufficient to impart antioxidant properties thereto of the reaction product of a polysulfide and a hydrocarbylmagnesium halide or a Grignard reagent.

12 Claims, No Drawings

ANTIOXIDANT COMPOSITIONS

BACKGROUND OF THE INVENTION

1. Field of the Invention

This application is directed to compositions having highly effective antioxidant characteristics comprising a major amount of an organic medium normally susceptible to oxidation, such as oils of lubricating viscosity or greases prepared therefrom including various functional fluids, and a minor amount of the reaction product of a polysulfide and a Grignard reagent. The oils of lubricating viscosity may be mineral oils, mineral oil fractions, synthetic oils or mixtures of mineral and synthetic oils. This application is further directed to the novel products or additives prepared by reacting said polysulfide and said Grinard reagent.

2. Description of the Prior Art

It is known to use mixtures of sulfur containing compounds, e.g., diesters of thiodicarboxylic acids and hindered phenols to stabilize organic polymers against exposure to light and air; U.S. Pat. Nos. 3,644,282 and 3,652,495. It is also known to use organo sulfur containing transition metal complexes as antioxidants for lubricating oils and for various other organic media, such as polymers; see for example U.S. Pat. Nos. 3,781,361 and 4,090,970. Polysulfides (e.g., polydisulfides) of the type contemplated herein, are obtained, for example, by reacting isobutylene and a sulfur halide. They are disclosed in U.S. Pat. Nos. 3,873,454 and 3,925,414 as being useful as extreme pressure and antiwear additives for lubricant compositions.

SUMMARY OF THE INVENTION

This application, however, is directed to the discovery that compositions having effective antioxidant characteristics are provided when certain polysulfides, e.g., polydisulfides, are reacted with a hydrocarbyl anion or its equivalent such as is afforded by a Grignard reagent, and the reaction product thereof is added in minor effective amounts to various organic media normally susceptible to oxidation.

This application accordingly is more specifically directed to compositions comprising a major proportion of an oil of lubricating viscosity, or greases prepared therefrom, containing a minor proportion sufficient to impart antioxidant properties thereto of the reaction product of a polydisulfide having at least one unit therein with the following general structure:

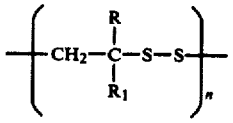

where n is from 2 to about 20 and R and $R_1$ are hydrogen or $C_1$–$C_{10}$ alkyl, and a hydrocarbylmagnesium halide or Grignard reagent, or other organometalic reagent customarily regarded as operating via a carbanion species, such as alkyl lithium compounds. The polydisulfide is preferably a cyclic polydisulfide and the Grignard reagent is preferably an aryl derivative. However, neither the polydisulfide nor the Grignard reagent are limited to these particular embodiments.

DESCRIPTION OF SPECIFIC EMBODIMENTS

In general, the polydisulfides embodied in this invention comprise such compounds having at least one structural unit therein as shown above. The polydisulfides useful herein may be prepared by any convenient means known to the art. Usually they are obtained by reacting a $C_2$–$C_{12}$ olefin, preferably a $C_4$–$C_8$ olefin, e.g., isobutylene, with a sulfur halide, e.g., sulfur monochloride, to produce an adduct; and then (1) reacting said adduct with an alkali metal hydrosulfide, e.g., sodium hydrosulfide, in a non-reactive liquid medium such as methanol, ethanol, propanol, 2-propanol and the like; or (2) reacting said adduct with an alkali metal sulfide or polysulfide, e.g., sodium sulfide and free sulfur, and then reacting the product thereof with an inorganic base, e.g., an alkali metal base such as sodium hydroxide. The step described above and labelled (1) results in a substantially cyclic product as described in U.S. Pat. No. 3,925,414 and the step labelled (2) results in a substantially open chain product as described in U.S. Pat. No. 3,697,499. As mentioned above, other synthetic methods can be used to prepare the polydisulfides. For example, the reaction of methallyl or 2-chloro-2-methylpropyl disulfide with NaSH, or the reaction of sodium methallythiosulfate (Bunte' salt) with NaSH. Especially preferred are polydisulfides such as the isobutylene reaction product having the following general structure prepared in accordance with U.S. Pat. No. 3,923,414:

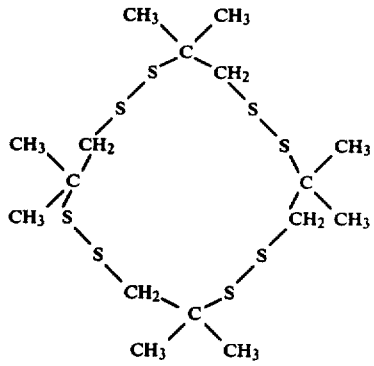

The Grignard reagents are obtained through readily available commercial sources or prepared in any appropriate manner known to the art, such as the reaction of magnesium with an organic halide. The hydrocarbylmagnesium halides useful in this invention have the following general formula:

$$RMgX$$

where R is alkyl or aryl or other organic groups having from 1 to about 30 carbon atoms and X is a halide anion. Preferred are aryl Grignard reagents such as phenylmagnesium bromide.

The novel antioxidant additives as embodied herein are in general prepared by reacting the above-described polydisulfides and a Grignard reagent or other organometallic reagent as defined above under ambient pressure at a temperature of from about 30° to 100° C. Other than ambient pressure may be used if thought desirous. The preferred temperature range is from about 35° to 65° C. Usually the reactants are reacted in a molar ratio of from about 0.1 to 1 of Grignard reagent to each equivalent of disulfide present in the reaction medium.

The antioxidant additives thusly prepared are effective in the standard conventional amounts usually used, that is, comprising from about 0.01 to about 5% by weight of the total composition. The lubricant or other oleaginous medium comprising the remainder of the composition may contain any other additives normally used in such compositions, such as lubricant improvers, extreme pressure agents, viscosity control agents, detergents, and V.I. improvers.

This application in its preferred embodiments is directed to lubricant compositions comprising a major amount of an oil of lubricating viscosity, or grease prepared therefrom and a minor amount of the hereindescribed antioxidant additives sufficient to improve the antioxidant properties of the aforementioned lubricant compositions, and to the novel antioxidant additives per se.

The compositions hereof may comprise any oleaginous materials that normally exhibit insufficient oxidation resistance properties. Especially suitable for use with the additives of this invention are liquid hydrocarbon oils of lubricating viscosity such as mineral oils or mineral oil fractions, synthetic oils or mixed mineral and synthetic oils. Lubricant oils, improved in accordance with the present invention, may be of any suitable lubricating viscosity. In general, as stated hereinabove, the lubricant compositions may comprise any mineral or synthetic oil of lubricating viscosity. The additives of this invention are also highly useful in greases and in functional fluids such as automotive fluids which include power steering fluids, automatic transmission fluids, brake fluids, power brake fluids, and various hydraulic fluids.

In instances where synthetic oils are desired in preference to mineral oils they may be employed alone or in combination with a mineral oil. They may also be used as the vehicle or base for grease compositions. Typical synthetic lubricants include polyisobutylene, polybutenes, hydrogenated polydecenes, polypropylene glycol, polyethylene glycol, trimethylol propane esters and neopentyl and pentaerythritol esters of carboxylic acids, di(2-ethylhexyl) sebacate, di(2-ethylhexyl) adipate, dibutyl phthalate, fluorocarbons, silicate esters, silanes, esters of phosphorous-containing acids, liquid ureas, ferrocene derivatives, hydrogenated mineral oils, chain-type polyphenyls, siloxanes and silicones (polysiloxanes), alkyl-substituted diphenyl ethers typified by a butyl-substituted bis(p-phenoxy phenyl) ether, phenoxy phenylethers, dialkylbenzenes etc.

As hereinbefore indicated, the aforementioned additives can be incorporated as antioxidation agents in grease compositions. When high temperature stability is not a requirement of the finished grease, mineral oils having a viscosity of at least 40 SSU at 150° F. are useful. Otherwise those falling within the range of from about 60 SSU to about 6,000 SSU at 100° F. may be employed. The lubricating compositions of the improved greases of the present invention, containing the above-described additives, are combined with a grease-forming quantity of a thickening agent. For this purpose, a wide variety of materials can be dispersed in the lubricating oil in grease-forming quantities in such degree as to impart to the resulting grease composition the desired consistency as for example soap thickeners, e.g., calcium and lithium soaps. Other thickening agents that may be employed in the grease formulation are non-soap thickeners, such as surface-modified clays and silicas, aryl ureas, calcium complexes and similar materials. In general, grease thickeners are employed which do not melt or dissolve when used at the required temperature within a particular environment; however, in all other respects, any material which is normally employed for thickening or gelling oleaginous fluids or forming greases may be used in the present invention.

The following examples are intended to exemplify the invention and in no way limit the scope thereof.

EXAMPLE I

Sulfur monochloride (1013 g. 7.5 moles) was charged into a 3-L (liter) 4-necked reaction flask equipped with a mechanical stirrer, condenser (drying tube attached), a thermometer, and a sub-surface gas sparger. While keeping the temperature between 45°-50° C., isobutylene was passed over 60 g. of methanol and into the reaction flask over an 8-hour period, during which 716 g. (12.8 moles) of isobutylene were consumed. The reaction mixture was then purged at 40° C. with a stream of nitrogen for 30 minutes and then filtered to yield 1579 g. of light amber liquid.

Sodium hydrosulfide, (1200 g.) and 1250 ml of ethanol were charged into a 5-L reaction flask fitted with a stirrer, condenser, (drying tube attached) thermometer and an addition funnel. After stirring to get a good dispersion of the solids, 620 g. of the above, isobutylene-sulfur monochloride adduct were added carefully from the addition funnel until a temperature of 45° C. was attained and then the addition was continued dropwise. The addition took about 2 hours. By carefully regulating the rate of addition, the temperature was kept at close to 40° C., and excessive foaming ($H_2S$ evolution) was avoided.

Following the aforementioned addition, the reaction mixture was heated, while stirring at 45°-50° C. for an additional 3 hours. After cooling to room temperature, it was filtered, the solids washed with hexane, with water and ether; and a water insoluble white solid product was collected. The filtrate was allowed to stay overnight under house vacuum. The solid product which precipitated from the filtrate was collected and washed several times with water and ether and dried. The combined solids were further purified by stirring vigorously in water and a little ether, collected and dried to yield 250 g. of white solid product, having a sulfur content of 53 percent. This product was found to have the following structure by elemental and instrumental (infrared and nuclear magnetic resonance spectroscopy) analysis, chemical degradation, and X-ray crystallography:

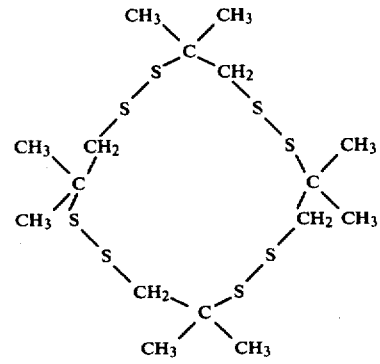

EXAMPLE II

Into a 5-liter reaction flask 2025 grams (15.0 moles of sulfur monochloride) were added and the contents were heated to 45° C. Through a sub-surface gas sparger, 1468 grams (26.2 moles of isobutylene gas) were fed into the reactor over a 5-hour period. The temperature was maintained between 45° and 50° C. At the end of the sparging, the reaction flask had an increase in weight of 1352 grams. Into a 12-liter reaction flask were added 2150 grams (16.5 moles) of 60 percent flake sodium sulfide, 240 grams (7.5 moles) sulfur, and a solution of 420 ml of isopropanol in 4,000 ml of water. The contents were heated to 40° C. The adduct of the sulfur monochloride and isobutylene previously prepared was added over a ¾-hour period while permitting the temperature to rise to 75° C. The reaction mixture was refluxed for 6 hours, and afterward the mixture was permitted to separate into layers. The lower aqueous layer was discarded. The upper organic layer was mixed with 2 liters of 10 percent aqueous sodium hydroxide and the mixture was refluxed for 6 hours. The organic layer was again removed and washed with one liter of water. The washed product was dried by heating at 90° C. at 30 mm Hg pressure for 30 minutes. The residue was filtered through diatomaceous earth to give 2,070 grams of a clear yellow-orange liquid.

The analysis of this product was as follows:

| | |
|---|---|
| % Carbon | 45.71 |
| % Hydrogen | 7.61 |
| % Sulfur | 46.6 |

The product was found to contain the open chain variation of the polydisulfide structure hereinbefore described.

EXAMPLE III

To 42.3 grams of 1,1,5,5,9,9,13,13-octamethyl-3,4,7,8,11,12,15,16-octathiacyclohexadecane, as prepared in Example I, in tetrahydofurane (1,000 ml) heated to 50° C. (to form a turbid solution) was added with stirring over a period of an hour a solution of phenylmagnesium bromide. The Grignard reagent was prepared from bromobenzene (56.7 g.) in ether (150 ml) and magnesium turnings (10.8 g.) in ether (300 ml). After continued stirring at 55° C. for ½ hr., the ether was distilled from the reaction mixture until the temperature reached 60° C. and then stirring was continued at 60° C. for 6 hrs. After work-up, solvent and low boiling fractions were removed by distillation up to 134° C. at less than 0.1 mm of mercury pressure, the residue was extracted with petroleum ether (b.p. 30°–60° C.). Thereafter the solvent was removed from the extract and the residue was subjected to column chromatography over neutral alumina using benzene for elution. Several fractions ($F_1$ to $F_6$) were individually collected which were considerably more soluble in refined petroleum lubricating oil than the reactant cyclic polydisulfide. Infrared spectroscopy showed that mono-substituted phenyl (690,735 $cm^{-1}$), gem-dimethyl (1385, 1370 $cm^{-1}$) and thiol (2560 $cm^{-1}$) were present in the reaction products.

Evaluation of Product

In order to evaluate the effectiveness of compositions comprising the additives in accordance with this invention, Example III was tested in the manner disclosed below. Test data appears in the Table. The base lubricant was a typical solvent refined mineral oil.

Catalytic Oxidation Test

A sample of the base lubricant is placed in an oven at a desired temperature. Present in the sample are the following metals either known to catalyze organic oxidation or commonly used materials of construction.

a. 15.6 sq. in. of sand-blasted iron wire,
b. 0.78 sq. in. of polished copper wire,
c. 0.87 sq. in. of polished aluminum wire and
d. 0.167 sq. in. of polished lead surface. Dry air is passed through the sample at a rate of about 5 liters per hour.

The comparative test results clearly demonstrate that the additives of this invention are highly useful in preventing the oxidative breakdown of lubricant compositions. After exposure to high temperature and air for extended periods of time, uninhibited mineral oils, for example, are especially susceptible to oxidation. The addition of a small amount of the novel compounds of this invention significantly reduces their deterioration.

Table

Catalytic Oxidation Test
40 Hr. 325°F. in Mineral Oil Base

| Additive | Conc; Wt. % | ΔNN[1] | ΔKV, %[2] | Pb Loss, mg | Sludge |
|---|---|---|---|---|---|
| None | — | 17.0 | 334 | 66 | Heavy |
| | | 17.8 | 202 | 171.3 | Light |
| Example III | 1 | 1.53 | 8 | 19.5 | Heavy |
| Fraction | 0.5 | 2.19 | 12 | 20.8 | Heavy |
| No. $F_1$ | 0.25 | 4.39 | 21 | 25.3 | Heavy |
| Example III | 1 | 1.2 | 17 | 13.7 | Heavy |
| Fraction | 0.5 | 1.9 | 10 | 23.1 | Heavy |
| No. $F_2$ | 0.25 | 13.7 | 57 | 77.2 | Heavy |
| Example III | 1 | 1.5 | 6 | 11.0 | Heavy |
| Fraction | 0.5 | 1.8 | 7 | 11.1 | Heavy |
| No. $F_3$ | 0.25 | 17.2 | 85 | 100.4 | Heavy |
| Example III | 1 | 1.6 | 8 | 13.1 | Heavy |
| Fraction | 0.5 | 1.9 | 10 | 21.7 | Heavy |
| No. $F_4$ | 0.25 | 16.4 | 73 | 129.6 | Heavy |
| Example III | 1 | 1.4 | 7 | 12.6 | Heavy |
| Fraction | 0.5 | 1.9 | 10 | 20.2 | Heavy |
| No. $F_6$ | 0.25 | 1.84 | 94 | 101.6 | Heavy |

1 *ΔNN, change in acid number.*
2 *ΔKV, % change in viscosity.*

What is claimed:

1. A composition comprising a major proportion of an oil of lubricating viscosity or grease prepared therefrom and a minor proportion sufficient to impart antioxidant properties thereto of material soluble therein consisting of the reaction product of a polydisulfide having at least one unit with the following structure:

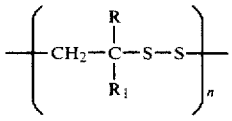

where n is from about 2 to 20 and R and $R_1$ are hydrogen or $C_1$–$C_{10}$ alkyl and a hydrocarbylmagnesium halide compound having the following structure: RMgX where R is alkyl, cycloalkyl or aryl having from 1 to about 30 carbon atoms and X is a halide.

2. The composition of claim 1 wherein the polydisulfide is a cyclic or open-chain polydisulfide.

3. The composition of claim 2 wherein said polydisulfide is a cyclic polydisulfide.

4. The composition of claim 3 wherein said cyclic polydisulfide has the following structure:

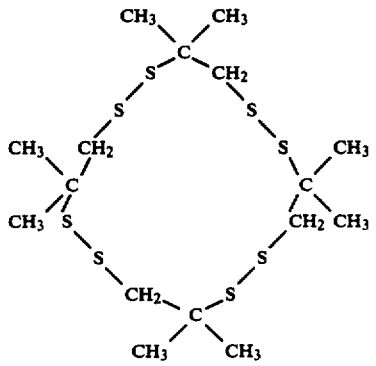

5. The composition of claims 1, 2, 3 or 4 wherein X in said compound having the structure RMgX is selected from the group consisting of bromide, chloride or iodide.

6. The composition of claim 5 wherein X is bromide and R is aryl in said compound having the structure RMgX.

7. The composition of claim 6 wherein RMgX is phenylmagnesium bromide.

8. The composition of claim 1 wherein said oil of lubricating viscosity is selected from the group consisting of power steering fluids, automatic transmission fluids, brake fluids, power brake fluids and hydraulic fluids.

9. The composition of claim 8 wherein said oil of lubricating viscosity is a hydraulic fluid.

10. The composition of claims 1 or 8 wherein said oil is a mineral oil.

11. The composition of claims 1 or 8 wherein said oil is a synthetic oil.

12. The composition of claim 1 wherein said polydisulfide is 1,1,5,5,9,9,13,13-octamethyl-3,4,7,8,11,12,15,16-octathiacyclohexadecane and said hydrocarbylmagnesium halide is phenylmagnesium bromide.

* * * * *